US008088052B1

(12) United States Patent
Sprague

(10) Patent No.: US 8,088,052 B1
(45) Date of Patent: Jan. 3, 2012

(54) CORE-STRENGTHENING EXERCISE APPARATUS

(76) Inventor: Edwin J. Sprague, Springfield, PA (US)

( * ) Notice: Subject to any disclaimer, the term of this patent is extended or adjusted under 35 U.S.C. 154(b) by 0 days.

(21) Appl. No.: 12/831,165

(22) Filed: Jul. 6, 2010

(51) Int. Cl.
*A63B 71/00* (2006.01)
*A63B 21/002* (2006.01)
*A63B 21/00* (2006.01)

(52) U.S. Cl. ..... 482/141; 482/91; 482/131

(58) Field of Classification Search ..... 482/15–17, 482/139, 141, 148, 91, 95, 96, 131, 132
See application file for complete search history.

(56) References Cited

U.S. PATENT DOCUMENTS 1,858,152 A * 5/1932 Hallowell et al. ..... 40/611.04
4,183,695 A * 1/1980 Wilcox ..... 404/6
4,278,228 A * 7/1981 Rebentisch et al. ..... 248/548
4,792,258 A * 12/1988 Goff ..... 404/6
5,501,647 A * 3/1996 Snyder ..... 482/38
5,836,858 A * 11/1998 Sharff ..... 482/106
6,203,473 B1 * 3/2001 Atwood ..... 482/95
7,476,187 B2 * 1/2009 Corte ..... 482/141
2003/0134726 A1 * 7/2003 Yu ..... 482/110
2005/0101461 A1 * 5/2005 Johnson ..... 482/141
2010/0126902 A1 * 5/2010 Garza et al. ..... 206/579
2010/0210430 A1 * 8/2010 Mulderrig et al. ..... 482/141

* cited by examiner

*Primary Examiner* — Allana Lewin
(74) *Attorney, Agent, or Firm* — Massinger Law Offices

(57) ABSTRACT

A core-strengthening exercise apparatus is comprised generally of three primary components, namely a pair of identically shaped and configured swing arms each of which is pivotally mounted at or proximate to its midpoint to a substantially C-shaped transverse bar member. The apparatus has two general modes of use. In a first mode of use, referred to as the "static mode", the subject apparatus may be oriented such that its swing arms rest on the floor with the bar member extending therebetween a distance above the floor to provide a stable gripping surface over which a plurality of exercises may be performed. In a second mode of use, referred to as the "dynamic mode", the apparatus is flipped over such that only the bar member is in contact with the floor supporting the swing arms there above. In this mode, the user supports his or her upper body in the plank position over the apparatus by grasping either end of each swing arm and resting his or her forearms along the longitudinal axis thereof. The unique curvature and configuration of the bar member creates an inherently unstable interface between the user and the floor permitting side-to-side or back-to-front rocking motions, pivoting motions about a vertical axis, or combinations thereof, all requiring control over core muscles to prevent loss of balance.

17 Claims, 8 Drawing Sheets

CORE-STRENGTHENING EXERCISE APPARATUS

FIELD OF THE INVENTION

The present invention relates to the field of exercise equipment. In particular, it relates to an adjustable exercise apparatus used in the performance of exercises directed especially toward increasing an individual's core muscle strength.

BACKGROUND OF THE INVENTION

In recent years, health and fitness practitioners have given greater and greater emphasis to core stability training for injury prevention, rehabilitation and performance enhancement. Sports strength and conditioning coaches and physiotherapists recommend that athletes perform regular core stability or trunk strength exercises to prevent injury. The rationale for such prophylactic training is that increased recruitment of the stabilizer muscles and increased strength of the prime movers will carry over into better posture and more control, both in daily life and in sporting movements.

The "core" actually consists of many different muscles that stabilize the spine and pelvis and run the entire length of the torso. These muscles stabilize the spine, pelvis and shoulder and provide a solid foundation for movement in the extremities. Core conditioning exercise programs need to target all these muscle groups to be effective.

The following list includes the most commonly identified core muscles as well as the lesser known groups. The goal of core stability is to maintain a solid, foundation and transfer energy from the center of the body out to the limbs. Muscles that accomplish this goal include:

- Erector Spinae—This group of three muscles runs along your neck to your lower back.
- Multifidus—these muscles extend and rotate the spine and are located under the erector spinae along the vertebral column.
- External Obliques—located on the side and front of the abdomen.
- Internal Obliques—located under the external obliques, running in the opposite direction.
- Gluteus maximus, hamstring group, piriformis—located in the back of the hip and upper thigh leg.
- Gluteus medius and minimus—located at the side of the hip
- Hip adductors—located at medial thigh.
- Hip Flexors—located in front of the pelvis and upper thigh. The muscles that make up the hip flexors include: the psoas major, illiacus, rectus femoris, pectineus and sartorius.
- Rectus Abdominis—located along the front of the abdomen, this is the most well-known abdominal muscle and is often referred to as the "six-pack" due to it's appearance in fit and thin individuals.
- Transverse Abdominis (WA)—located under the obliques, it is the deepest of the abdominal muscles (muscles of your waist) and wraps around your spine for protection and stability.

In order to strengthen and condition the above, there are three major groups of exercises. The first group of exercises is that which focuses on the recruitment of the small deep-lying stabilizing muscles, transversus abdominis and multifidus, often taken from clinical Pilates. The second group is traditional dynamic strength exercises for the prime movers of the trunk, often performed on the floor. The final group is static bodyweight exercises focusing on developing stability and/or strength endurance in certain postures, and requiring co-contraction of the small stabilizer and larger mobilizer muscles, such as the popular 'plank' exercise.

An unfortunate reality is that the routine performance of the above core exercises leads to boredom. It has been said that 'core exercises' quickly become 'bore exercises'! It takes self-discipline to do 20-30 minutes of the same exercises three or more times a week over a long period. As a consequence, adherence to a core-strengthening program can be challenging. The second limitation is physiological. The principles of specificity and progression apply to core work in the same way as they do to any other body training. It is quite common for an athlete to perform the same core routine over a long period and get very good at four or five movements or 'holds'. But teach the same athlete a new core exercise and they will find it difficult, simply because it is a new stimulus. Clearly a need exists for a greater variety of such exercises in order to optimize the benefits of a core strengthening program.

Various apparatus have been developed to add greater variety to core exercise training, some offering greater challenges, and therefore benefits, to the user versus apparatus-free training. For instance, stability ball exercises also known as Swiss ball exercises, are believed to activate the trunk musculature to a greater extent than more traditional resistance exercises, thereby affording increased benefit to traditional dynamic strength exercises. The unstable surface of the ball is thought to provide a greater challenge to the core muscles than exercising on a stable surface. This is likely because the temporary loss of balance resulting from the unstable surface activates involuntary muscle contraction rather than a targeted muscle or muscle group performing a predictable voluntary movement to which the muscle can adapt through repetition. The subject invention facilitates core stability and strengthening using a wider variety of movements to maximize adaptations and muscle groups trained.

SUMMARY OF THE INVENTION

The subject apparatus rather broadly provides an exercise apparatus used in the performance of core-strengthening exercises. In a preferred embodiment, the apparatus is comprised generally of three primary components, namely a pair of identically shaped and configured swing arms each pivotally mounted at or proximate to its midpoint to a generally C-shaped transverse bar member. The apparatus has two general modes of use. In a first mode of use, referred to as the "static mode", the subject apparatus may be oriented such that its swing arms rest on the floor with the bar member extending therebetween a distance above the floor to provide a stable gripping surface upon which a' plurality of isometric and isotonic exercises may be performed such as pushups, dips and plank exercises. In a second mode of use, referred to as the "dynamic mode", the apparatus is flipped over such that the bar member is in contact with the floor and the swing arms are supported there above, normally parallel to the floor. In this mode, the user supports his or her upper body in the plank position over the apparatus by resting the forearms along the longitudinal axis of each swing arm. The unique curvature and configuration of the bar member creates an inherently unstable interface between the user and the floor permitting side-to-side, forward-rearward or twisting motions, or combinations thereof, all requiring control over core muscles to prevent loss of balance.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide an exercise apparatus for strengthening of the core muscles.

It is another primary object of the subject invention to provide a core-strengthening exercise apparatus upon which both isometric and isotonic exercises may be performed.

Another primary object of the subject invention is to provide a core-strengthening exercise apparatus specifically adapted for the performance of exercises that recruit core muscles for balance and control.

It is another object of the subject invention to provide a core-strengthening exercise apparatus that is fabricated from materials that are durable, corrosion-resistant, and non-absorbent.

Another object of the subject invention is to provide a core-strengthening exercise apparatus that is fabricated from materials that are sufficient in weight and thickness to withstand heavy loads.

Another object of the subject invention is to provide a core-strengthening exercise apparatus that is fabricated from materials that may be finished to possess a smooth, easily cleanable surface.

Still another object of the subject invention is to provide a core-strengthening exercise apparatus that is fabricated from materials that are resistant to pitting, chipping, crazing, scratching, scoring, distortion and decomposition.

An additional object of the subject invention is to provide a core-strengthening exercise apparatus capable of rapid disassembly into its primary component parts which together may be stored in a relatively compact flat container for ease of storage and shipping.

Another object of the subject invention is to provide a core-strengthening exercise apparatus that is relatively simple in design and therefore capable of rapid construction at relatively low costs.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention. Such description makes reference to the annexed drawings wherein:

DETAILED DESCRIPTION OF THE PREFERRED EMBODIMENT

Figure 1:
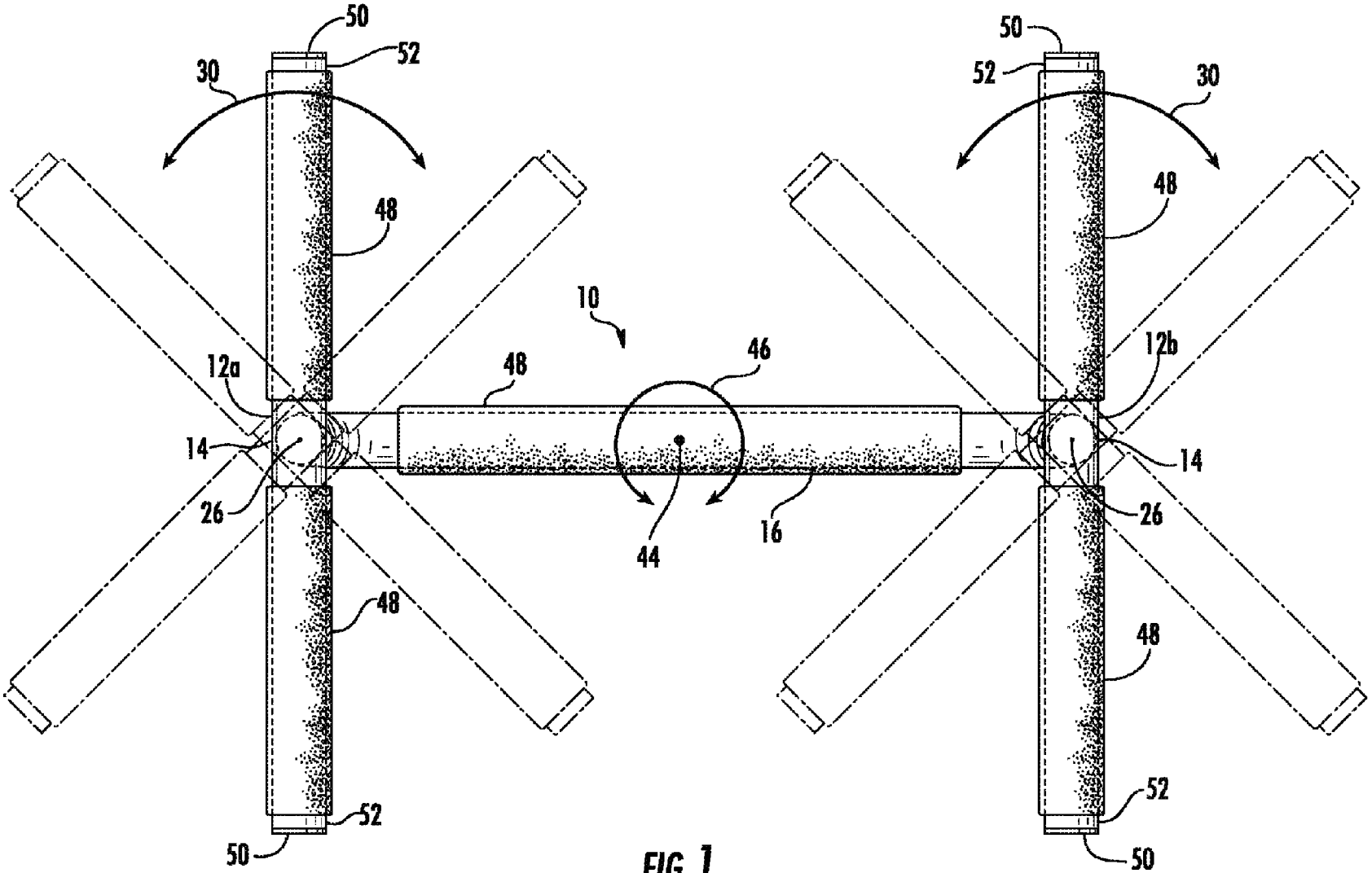
FIG. 1 is a plan view of the core-strengthening apparatus of the subject invention.

It should be clearly understood at the outset that like reference numerals are intended to identify the same structural elements, portions or surfaces consistently throughout the several drawings herein, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "forward", "rearward" or "side-to-side" and the like generally refer to the direction of travel relative to a component's axis of elongation, or axis of rotation, as appropriate.

Figure 2:
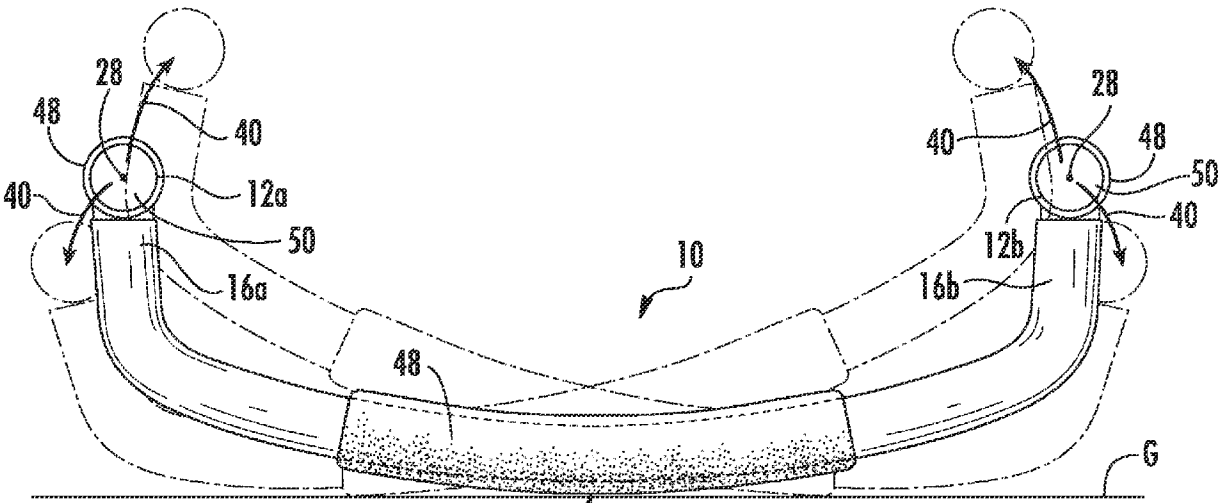
FIG. 2 is a frontal view of the subject exercise apparatus.
Figure 3:
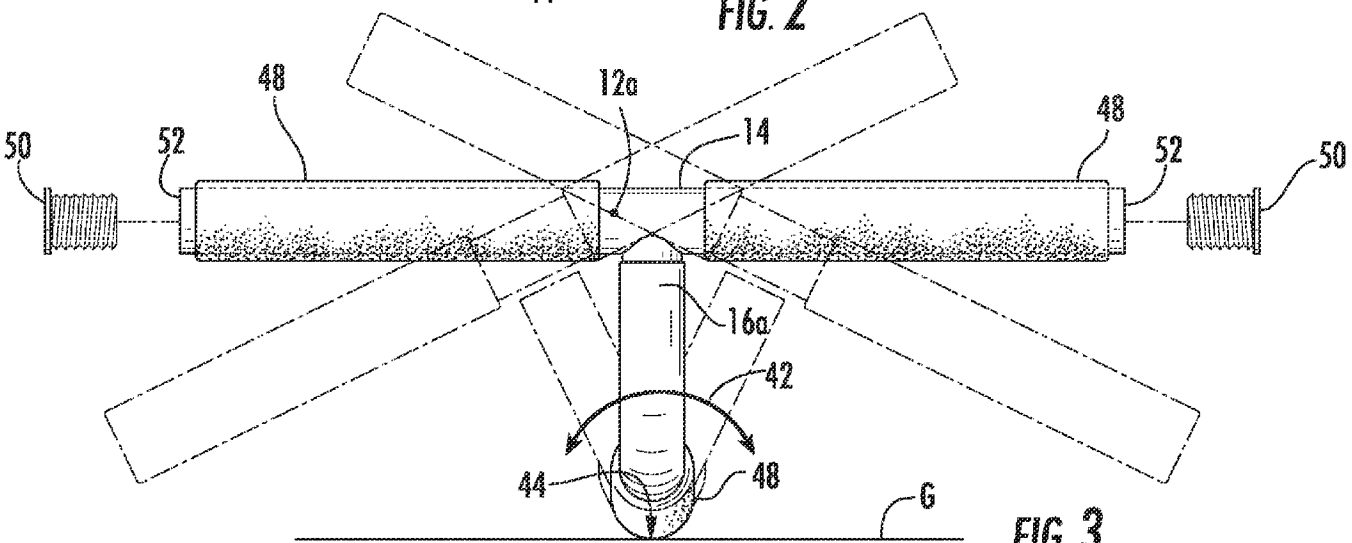
FIG. 3 is a side view of the subject exercise apparatus.

Reference is made to FIGS. 1-3 in which a preferred embodiment of the subject core-strengthening exercise apparatus (also referred to as "exercise apparatus"), denoted generally by reference numeral 10, is illustrated. Exercise apparatus 10 is comprised generally of three primary components, namely a pair of identically shaped and configured swing arms 12*a* and 12*b*, each being pivotally mounted at or proximate to its midpoint 14 to a generally C-shaped transverse bar member 16. Each swing arm 12*a,b* is straight and, for reasons which will be appreciated, has a length sufficient to support a person's forearm and hand, or approximately 14 to 20 inches.

Figure 4:
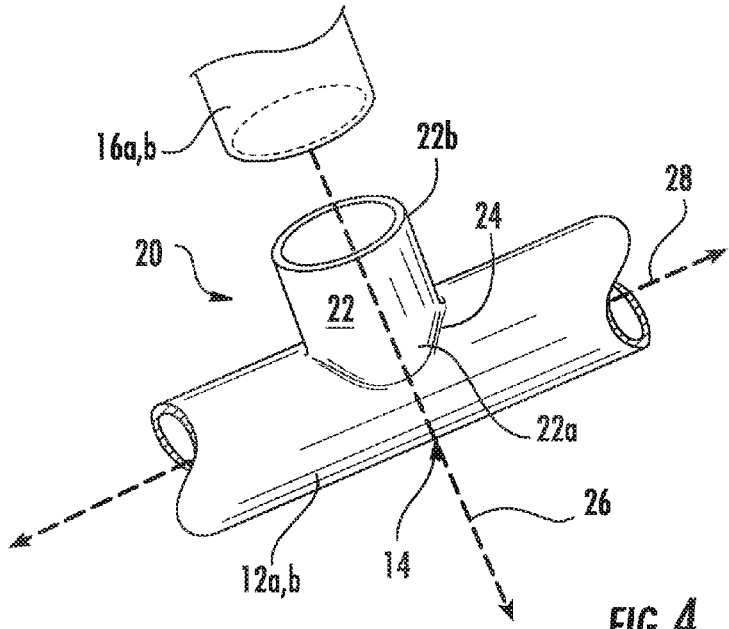
FIG. 4 is an enlarged perspective view of the connection member component of the subject apparatus.

More specifically, first swing arm 12*a* is perpendicularly mounted to a first end 16*a* of bar member 16 via connection means 20 (FIG. 4) which in a preferred embodiment is comprised of tubular connection member 22 having a proximal end 22*a* permanently connected to bar member 16 in perpendicular fashion via circumferential weld 24, and a distal end 22*b* sized and shaped for slidable engagement with first end 16*a* of bar member 16 either internally (as shown in FIG. 4) or externally (not shown). Similarly, second swing arm 12*b* is perpendicularly mounted to a second end 16*b* of bar member 16 via connection means 20 which in a preferred embodiment is comprised of tubular connection member 20*b* having a proximal end 22*a* permanently connected to bar member 16 in perpendicular fashion via circumferential weld 24, and a distal end 22*b* sized and shaped for slidable engagement within or around second end 16*a* of bar member 16. For the purpose of clarity, the term "perpendicular" herein means that the central axis 26 of one end 16*a,b* of bar member 16 intersects the longitudinal axis 28 of a corresponding swing arm 12*a,b* forming a "T" connection. An important characteristic of connection means 20 is that it permits rotation of each swing arm 12*a,b* about central axis 26 of bar member 16, as indicated by directional arrow 30, to accommodate various arm positions of the user when apparatus 10 is used in the dynamic mode described below. For instance, rotating swing arms 12*a,b* to bring the hands closer together alleviates stress on the user's shoulder joints and is a more natural and comfortable position than having the forearms in parallel relationship.

Figure 7:
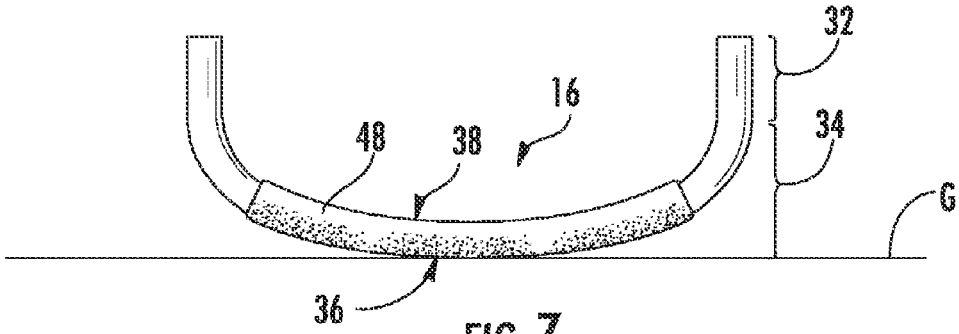
FIG. 7 is a frontal view of the bar member of the subject apparatus.

Turning now to FIGS. 2 and 7 in particular, a first embodiment of the substantially C-shaped bar member 16 may be observed. Although several variations of the shape of bar member 16 are contemplated such as those illustrated in FIGS. 8-10 for example, all embodiments include a first portion 32 comprised of first straight end portion 16*a* and second straight end portion 16*b* which are in parallel relationship to one another, and a middle portion 34 therebetween. Middle portion 34 may have a variety of configurations as described more fully below, all of which are symmetrical. In the embodiment of FIGS. 2 and 7, middle portion 34 is arcuate in shape having an outside radius 36 and inside radius 38. Outside radius 36 is intended to be in contact with the floor or ground "G" during use of apparatus 10 in the dynamic mode of operation. As may be readily appreciated, apparatus 10 is inherently unstable when outside radius 36 is in contact with the ground G because of its curved shape which facilitates a side-to-side or lateral rocking motion as illustrated in FIG. 2 and as indicated by directional arrows 40. Moreover, because of its cylindrical design, round or oval in cross-section, bar member 16 is also capable of pivoting forward and rearward along arc 42 about the contact point 44 that exists between outside radius 36 and ground G as illustrated in FIG. 3. This motion in turn causes pivoting of swing arms 12*a,b* about contact point 44 as well. Referring to FIG. 1, it should also be appreciated that bar member 16 is also capable of pivoting about a vertical axis of rotation as defined by apparatus/floor contact point 44 and indicated by arc 46, and that an infinite number of such contact points exist between end portions 16*a* and 16*b* of bar member 16. Accordingly, an infinite number of combinations of side-to-side, forward-rearward and pivoting motions are possible by virtue of the above described construction of bar member 16 which may also be constructed in a variety of lengths to vary the overall width of exercise apparatus 10 and accommodate for differently sized users. Alternatively, an alternate embodiment of bar member 16 is telescopically adjustable in length in a manner well known to those skilled in the art.

Swing arms 12*a,b* and bar member 16 are preferably constructed of tubular steel, which is relatively inexpensive, durable, light weight and non-corrosive. It will be appreciated that various alternative materials may be used, such as other metals, plastics, composites, or wood. Further, it will be appreciated that, rather than being hollowed tubular members, swing arms 12*a,b* and bar member 16 may be of solid construction although the former construction is preferred to produce a product light in weight.

Secondary components of exercise apparatus 10 include grip members 48 which are secured to at least a portion of each swing arm 12*a,b* and bar member 16 to provide softer and slip-resistant surface for the user to grip during use of the apparatus. Grip members may, for instance, be constructed of PVC foam padding of variable thickness or may be applied to the aforesaid surfaces via dipping or by other means well known to those skilled in the art. End caps 50 preferably but not essentially constructed of plastic and shaped for frictional engagement within the open ends 52 of each swing arm 12*a,b* are also provided.

Figure 8:
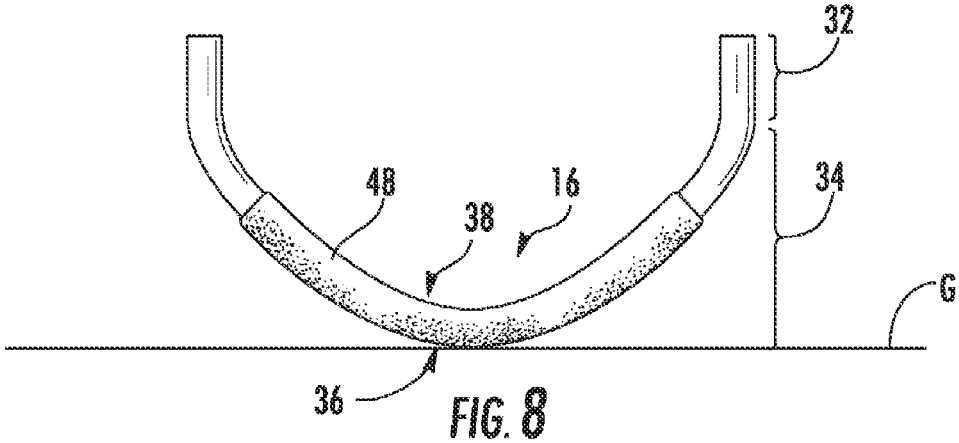
FIG. 8 is a frontal view of a second embodiment of the bar member.
Figure 9:
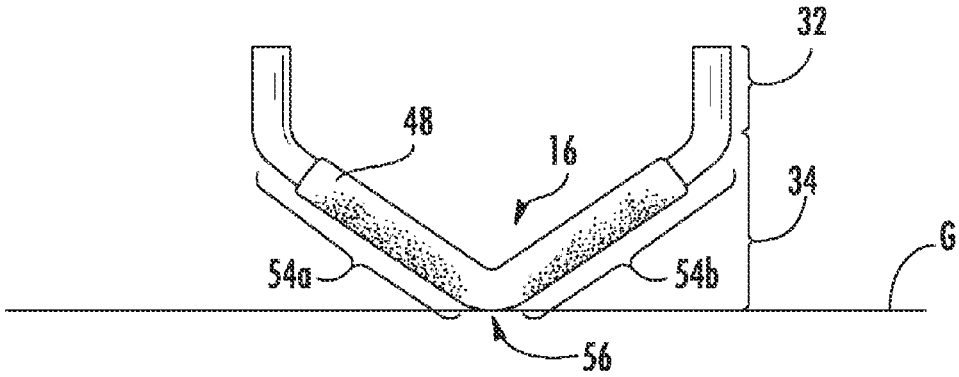
FIG. 9 is a frontal view of a third embodiment of the bar member.
Figure 10:
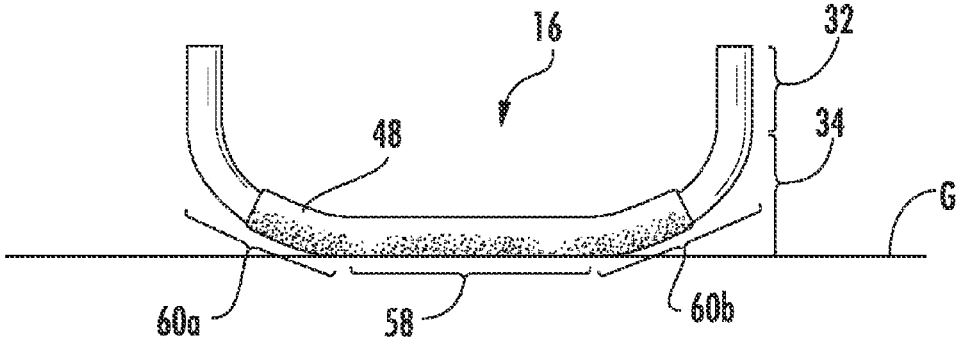
FIG. 10 is a frontal view of a fourth embodiment of the bar member.

Referring now to FIGS. 8-10 it will be appreciated that various other modifications or changes to the structure of bar member 16 may be made to afford greater or lesser degrees of instability when in contact with the work surface (i.e., ground G). Referring specifically to FIG. 8, the outside radius 36 of bent portion 34 of bar member 16 may have a more acute curvature to provide less stable communication with the working surface. As may be appreciated, a greater degree of curve will require greater effort of the user to maintain balance by resisting the tendency of apparatus 10 to rock laterally. An even more aggressive design is seen in the embodiment of FIG. 9 where first and second straight portions 54*a,b* of middle portion 34 are separated by angled joint 56 which may vary in degree. This embodiment essentially requires the user to balance on a single point of contact which is highly unstable relative to the aforementioned embodiments. Referring now to FIG. 10, yet another embodiment of bar member 16 is illustrated wherein middle portion 34 is divided into left and right arcuate portions 60*a,b* with a straight section 58 therebetween. Straight section 58 provides a larger surface area in contact with ground G thereby affording greater lateral stability. The user is required to consciously lean left or right to cause lateral rocking of the apparatus.

Figure 11:
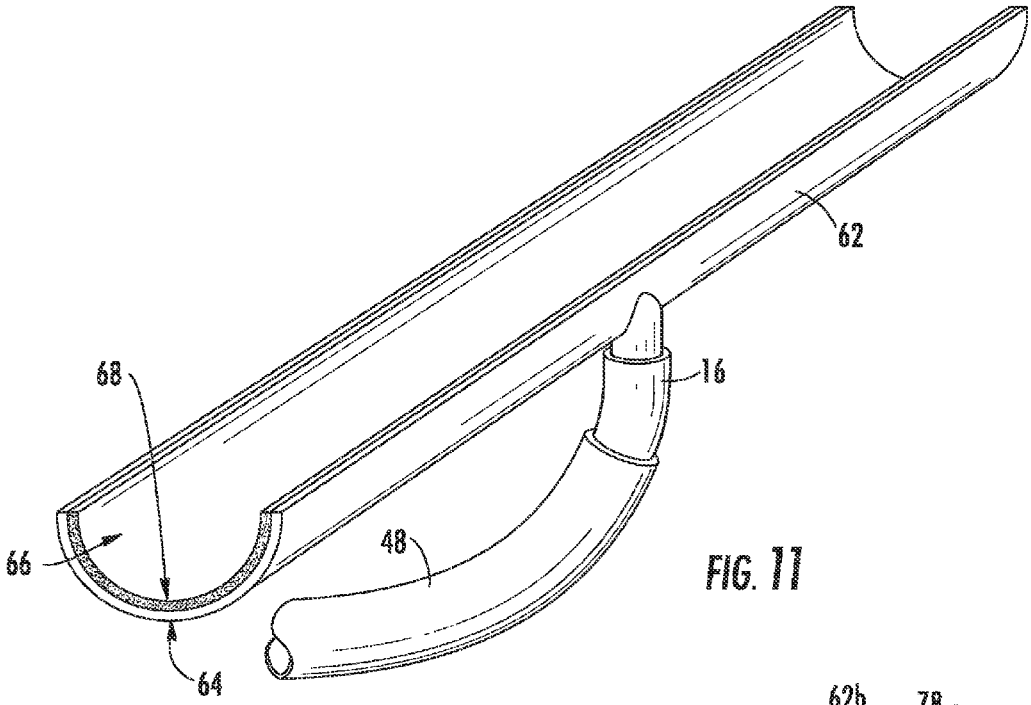
FIG. 11 is a perspective view of an alternate embodiment of the swing arm component of the subject apparatus.
Figure 12:
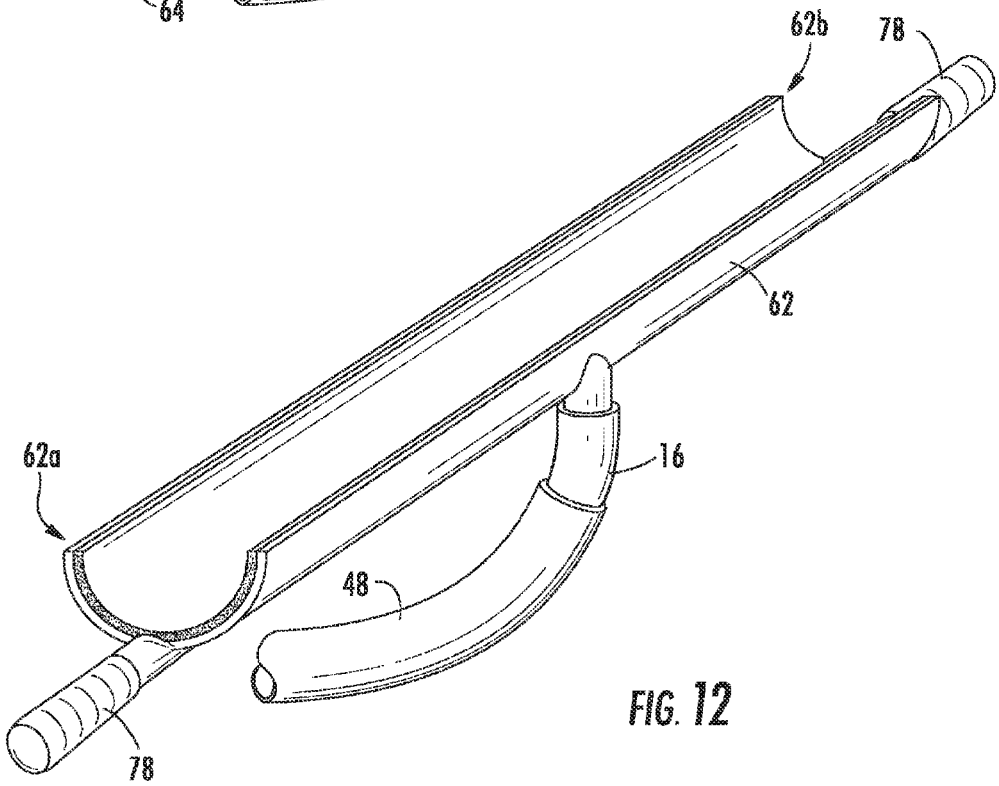
FIG. 12 is a perspective view of another embodiment of the swing arm component of the subject apparatus.

Apparatus 10 may be modified to provide a more supportive and secure surface for receipt of the user's forearms when the apparatus is employed in its dynamic mode. Specifically, referring to FIGS. 11 and 12, swing arms 12*a,b* have been replaced with a pair of elongated cradles 62 pivotally attached to bar member 16 in the same manner as swing arms 12*a,b*. Each cradle 62 is generally C-shaped in cross-section having an outer (bar member engaging) convex surface 64 and an inner concave surface 68 for the receipt of a user's forearm. Concave surface 68 preferably but not essentially is lined with padding 68 to provide greater comfort to the user. In the embodiment of FIG. 12 at least one end 62*a,b* of each cradle 62 terminates in axial extending handle 78 to provide a gripping surface during use of the apparatus in its dynamic mode.

Figure 13:
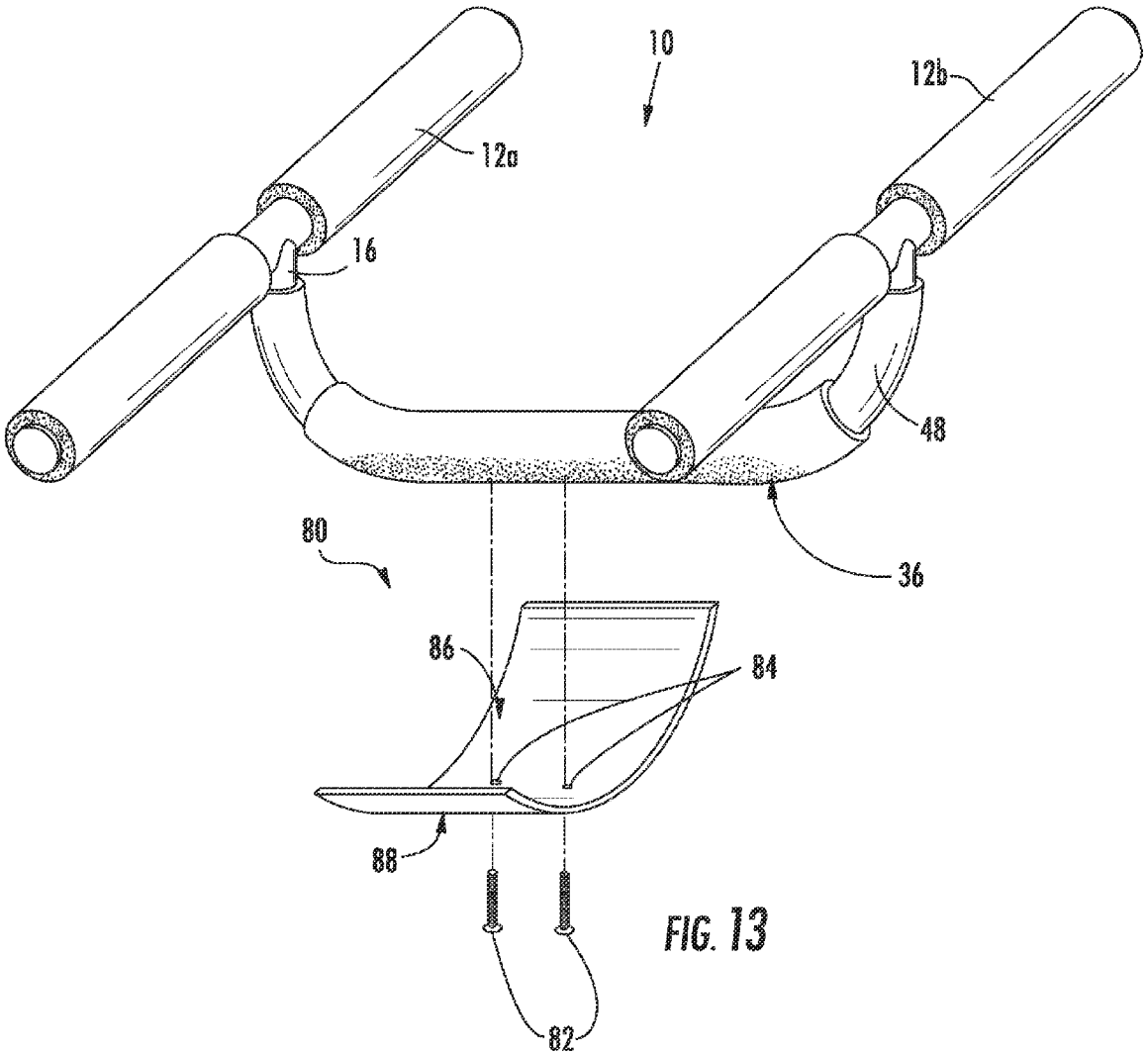
FIG. 13 is a partial exploded view of the subject apparatus including a pivot plate accessory.
Figure 14:
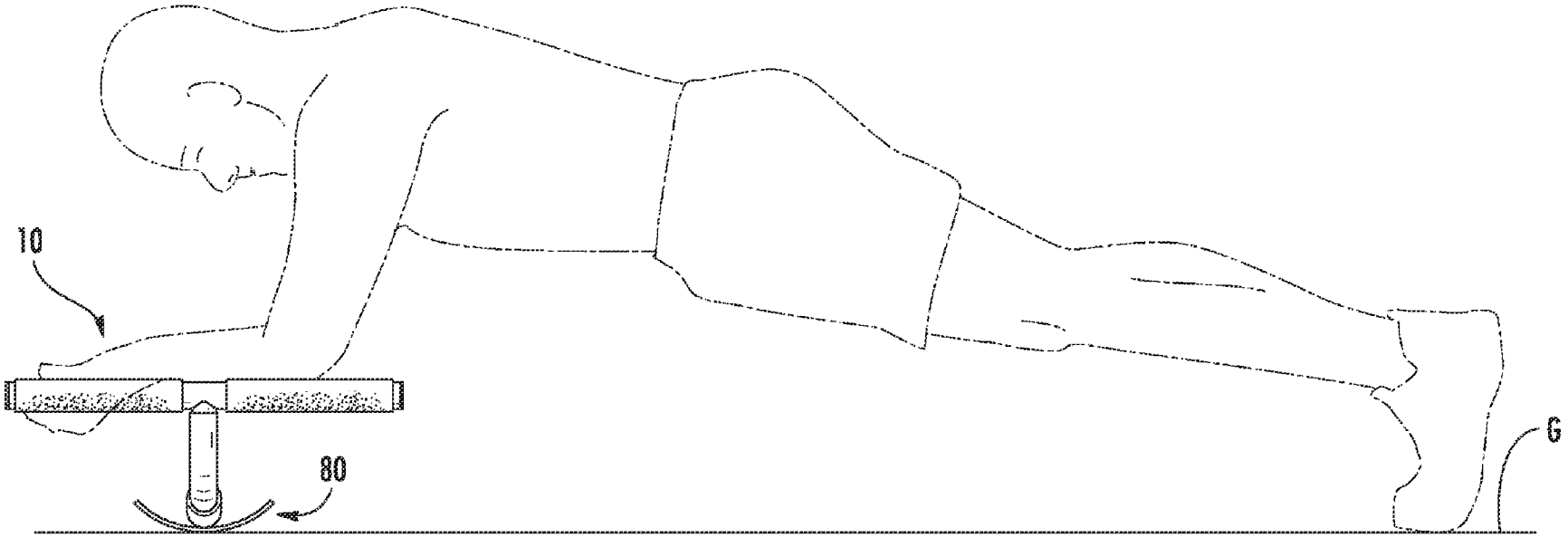
FIG. 14 is a side view of the subject apparatus and pivot plate accessory employed in dynamic mode by a user.

Referring to FIGS. 13 and 14, core-strengthening apparatus 10 may modified to provide greater stability to forward-rearward rocking motion by mounting pivot plate 80 to the outside radius 36 of bar member 16. Because of its relatively short cross-sectional diameter, bar member 16 pivots easily about its longitudinal axis on its outside radius 36 (i.e., it is highly unstable in the forward-rearward directions). Some users, particularly beginners with a weak core, may require a less unstable apparatus-to-ground interface until their core is strengthened. Mounting of pivot plate 80 to outside radius 36 effectively increases the diameter of outside radius 36 such that gentler forward-rearward motion is made possible. Pivot plate 80 is a curved plate of metal, plastic, wood or other suitable material and is comprised of a concave bar member engaging surface 86 and a convex floor contacting surface 88. Pivot plate 80 is mounted to the midpoint of outside radius 36 of bar member 16 via fasteners 82 disposed through mounting holes 84 and into bar member 16 in a well known manner. Other suitable mounting means may also be employed.

Method of Use

The apparatus has two general modes of use; static and dynamic.

Static Mode Exercises

In a first mode of use, referred to as the "static mode", the subject apparatus may be oriented such that its swing arms 12*a,b* (or cradles 80) rest on the ground G with the bar member extending therebetween a distance above the floor to provide a stable gripping surface over which a plurality of exercises may be performed.

Example 1

Push-Ups

Figure 5:
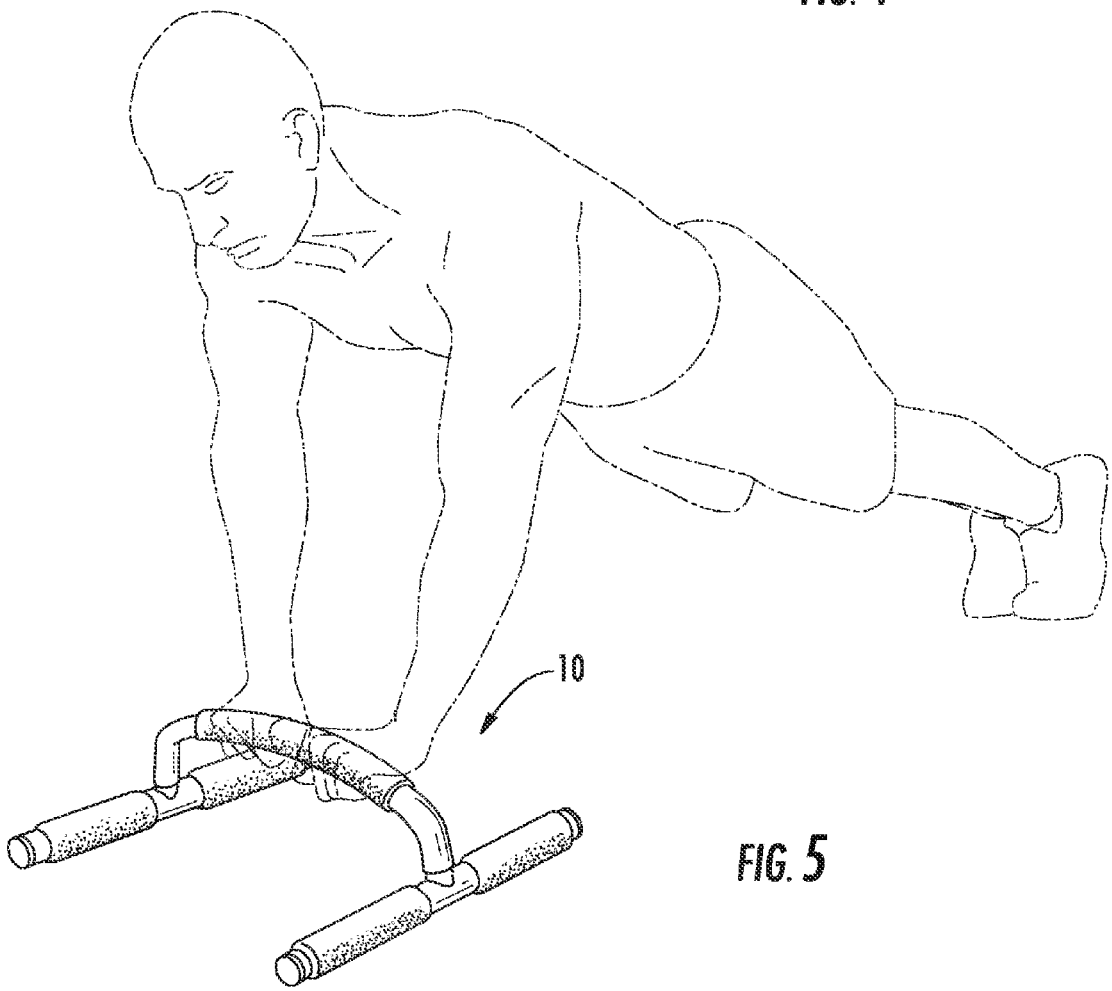
FIG. 5 is a perspective view of the subject apparatus being employed in its static mode by a user.

Referring to FIG. 5, the classic push-up exercises the shoulder girdle stabilizers, pectoral muscles, and triceps. The user starts with hands on bar member 16, legs extended behind, feet together, and maintains a neutral spine. For a modified position, the user starts with knees on the floor. The user slowly lowers the body towards apparatus 10 maintaining alignment with the core muscles engaged and then presses back up to start position. For a greater challenge the user lifts one leg up as he/she lowers the body towards exercise apparatus 10.

Example 2

Quadruped Exercises

The quadruped exercise works the abdominals, the lumbar and shoulder stabilizers, the shoulder extensors, and the hip extensors. The user starts with both hands wide on bar member 16 and knees on the floor. The user then lifts one leg off the floor to complete extension and holds parallel to the floor. User holds for a three count, returns to the floor and alternates legs. For a greater challenge, one arm and the opposite leg are lifted and held for three breaths, making sure to keep the spine neutral and the core muscles engaged. The user then lowers to the starting position and repeats on the other side.

Dynamic Mode Exercises

Figure 6:
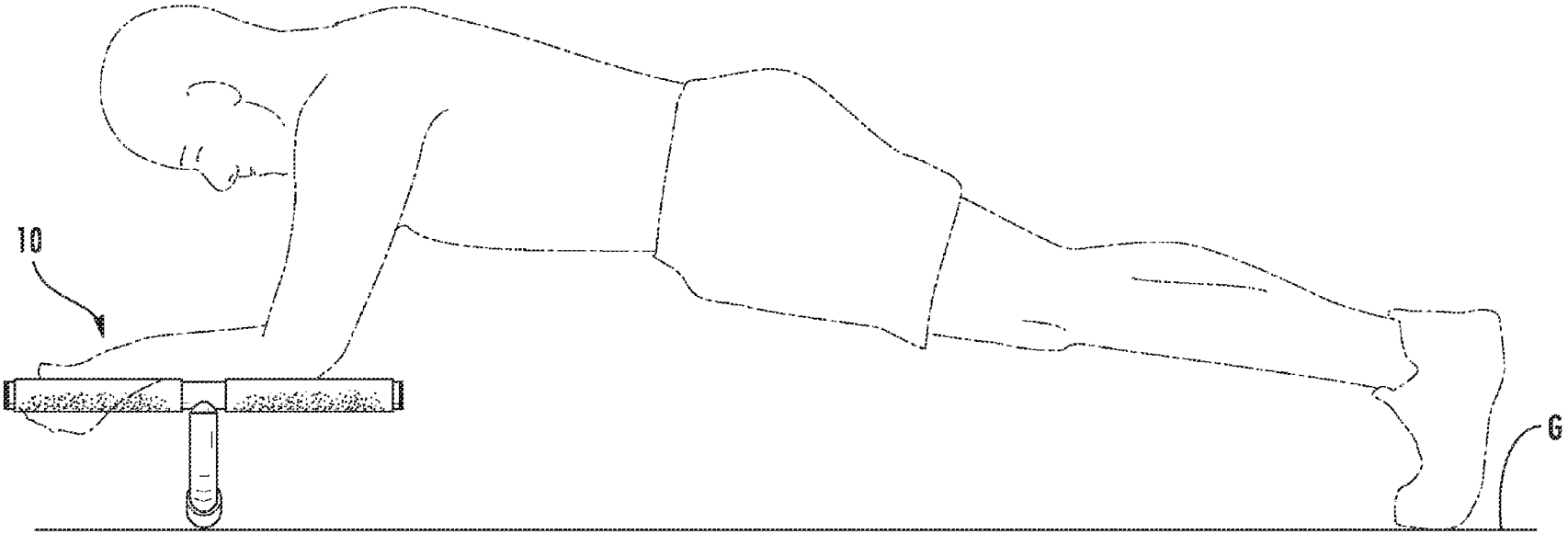
FIG. 6 is a side view of the subject apparatus being employed in its dynamic mode by a user.

Referring to FIG. 6, in a second mode of use, referred to as the "dynamic mode", apparatus 10 is oriented such that only outside radius 36 of bar member 16 is in contact with the floor, supporting swing arms 12*a,b* a distance there above. In this mode, the user supports his or her upper body in the plank position (described below) over the apparatus. The unique curvature and configuration of the bar member creates an inherently unstable interface between the user and the floor permitting side-to-side forward-rearward rocking motions, pivoting motions, or combinations thereof, all requiring control over core muscles to prevent loss of balance.

Example 1

The Plank

The "plank" is a common exercise that requires good abdominal strength and co-contraction of the abdominal wall musculature to hold the lumbar spine and pelvis in correct alignment. It targets the rectus abdominis and abdominal wall (TVA/internal obliques. The user grasps either end of each swing arm and rests his or her forearms along the longitudinal axis thereof, maintaining a straight body position supported by the elbows and toes. The abs are braced (contracted toward the spine) and the calves and thighs gently squeezed to prevent the back from arching, and the low back set in the neutral position. Sometimes this requires a pelvic tilt to find the right position. The aim is to hold this position, keeping the upper spine extended, for an increasing length of time up to a maximum of 60 secs. Two to three sets are performed keeping the shoulders back and chest out, while maintaining the neutral lumbar position. This makes the exercise considerably more challenging.

To progress in difficulty, the user presses forward from the toes, pivoting forward on the apparatus as far as possible without losing balance and toppling over forward. The user then pulls rearward from the toes pivoting rearward, past the neutral position as far back as possible without losing balance, and then presses forward again repeating the exercise. Note that pivot plate 80 may be utilized to afford greater forward-rearward stability for beginners. A similar series of movements is then performed transversely, or in the side-to-side direction. Here, the user need only shift his or her weight slightly to the left or right to cause bar member to rock laterally on its outside radius 36. Finally, the oblique muscles may be recruited to pivot apparatus 10 about a vertical axis: Here, the user contracts the obliques on one side of the body, drawing an elbow inward towards the hip. The exercise is repeated on the opposite side. Combinations of the above exercises may also be performed. Note that movement of apparatus 10 in any of the above directions, or combinations thereof over even short distances causes recruitment of core muscles to prevent loss of balance.

Example 2

The Plank on One Leg

Variations of the above may also be performed. For example, the user can lift one leg just off the floor and balance on the other; holding the position without tilting at the pelvis. Proper form requires the user to keep the abs pulled in to prevent the back from arching. Here again, the calves, thighs, and hips are gently contracted to keep the body in a straight line and the user should look towards the floor so that the neck stays in proper alignment with the spine. The user should take care to make sure that the lower back stays in alignment when lifting the leg; there is no need to lift as high as the leg can go. The leg that is on the floor and that side of the body will work much harder. Hold 10-30 seconds on the first leg before switching to the other leg. For an even more challenging variation, the user rests the toes on top of an elevated surface of varying heights. One leg may be lifted just off the elevated surface for an even greater challenge. All of the above may be performed while performing the above described forward-rearward, side-to-side and pivoting motions. Some users will find it challenging just to hold the proper positions without losing balance due to the inherent instability of apparatus 10 when used in the dynamic mode. The above are only sample of core exercises that may be performed using the subject apparatus to develop core stability.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A core-strengthening exercise apparatus, comprising:

a) a substantially C-shaped bar member having a first end portion, a middle portion and a second end portion; said first end portion and said second end portion being substantially parallel and approximately shoulder width apart; said middle portion having a longitudinal axis, at least a portion of said longitudinal axis being curvilinear, the apparatus being pivotable about said axis in a forward and rearward arcuate direction and along said curvilinear portion of said axis in a side-to-side direction;

b) a first swing arm pivotally and perpendicularly mounted at or proximate to its midpoint to the end of said first end portion for supporting a first forearm of a user; and c) a second swing arm pivotally and perpendicularly mounted at or proximate to its midpoint to the end of said second end portion for supporting a second forearm of a user;

whereby, in a first mode of use, the apparatus may be oriented with said swing arms resting on the floor with said bar member extending therebetween a distance above the floor to provide a stable gripping surface upon which a plurality of isometric and isotonic exercises may be performed; and whereby, in a second mode of use, the apparatus is inverted with said bar member in contact with the floor and supporting said swing arms above the floor to provide a pair of supports upon which a user may rest the forearms while assuming a plank position, said middle portion providing an interface between the user and the floor thereby invoking the user's core muscles to prevent loss of balance.

2. The core-strengthening exercise apparatus of claim 1 wherein said first swing arm and said second swing arm each have a length sufficient to support a person's forearm and hand.

3. The core-strengthening exercise apparatus of claim 1 wherein said middle portion is arcuate in shape along said longitudinal axis, having an outside radius and an inside radius.

4. The core-strengthening exercise apparatus of claim 1 wherein said middle portion is comprised of first and second straight portions separated by an angled joint to provide a single point of contact between said middle portion and a supporting surface thereby making it more difficult for a user to maintain balance when utilizing the apparatus in its inverted second mode of use.

5. The core-strengthening exercise apparatus of claim 1 wherein said middle portion is comprised of first and second arcuate portions with a straight section therebetween.

6. The core-strengthening exercise apparatus of claim 1 further including a pivot plate comprised of a concave bar member engaging surface and a convex floor contacting surface; said pivot plate being mounted to said middle portion of said bar member.

7. The core-strengthening exercise apparatus of claim 1 further including grip members secured to at least a portion of said first swing arm, said second swing arm and said bar member.

8. A core-strengthening exercise apparatus, comprising:

a substantially C-shaped bar member having a first end portion, a middle portion and a second end portion; said first end portion and said second end portion being substantially parallel and approximately shoulder width apart; said middle portion having a longitudinal axis, at least a portion of said longitudinal axis being curvilinear, the apparatus being pivotable about said axis in a forward and rearward arcuate direction and along said curvilinear portion of said axis in a side-to-side direction;

b) a first cradle pivotally and perpendicularly mounted at or proximate to its midpoint to the end of said first end portion;

c) a second cradle pivotally and perpendicularly mounted at or proximate to its midpoint to the end of said second end portion; said first cradle and said second cradle each being substantially C-shaped in cross-section, having an outer bar member engaging convex surface and an inner concave surface for receiving a user's forearm; and d) a pivot plate comprised of a concave bar member engaging surface and a convex floor contacting surface; said pivot plate being mounted to said middle portion of said bar member;

whereby, in a first mode of use, the apparatus may be oriented with said cradles resting on the floor with said bar member extending therebetween a distance above the floor to provide a stable gripping surface upon which a plurality of isometric and isotonic exercises may be performed; and whereby, in a second mode of use, the apparatus is inverted with said bar member in contact with the floor and supporting said cradles above the floor to provide a pair of forearm supports within which a user may rest the forearms while assuming a plank position, said middle portion providing an interface between the user and the floor thereby invoking the user's core muscles to prevent loss of balance.

9. The core-strengthening exercise apparatus of claim 8 wherein said first cradle and said second cradle each have a length sufficient to support a person's forearm.

10. A core-strengthening exercise apparatus, comprising:

a) a substantially C-shaped bar member having a first end portion, a middle portion and a second end portion; said first end portion and said second end portion being substantially parallel and approximately shoulder width apart; said middle portion having a longitudinal axis, at least a portion of said longitudinal axis being curvilinear, the apparatus being pivotable about said axis in a forward and rearward arcuate direction and along said curvilinear portion of said axis in a side-to-side direction;

b) a first swing arm pivotally and perpendicularly mounted at or proximate to its midpoint to the end of said first end portion for supporting a first forearm of a user;

c) a second swing arm pivotally and perpendicularly mounted at or proximate to, its midpoint to the end of said second end portion for supporting a second forearm of a user; and d) a pivot plate comprised of a concave bar member engaging surface and a convex floor contacting surface; said pivot plate being mounted to said middle portion of said bar member;

whereby, in a first mode of use, the apparatus may be oriented with said swing arms resting on the floor with said bar member extending therebetween a distance above the floor to provide a stable gripping surface upon which a plurality of isometric and isotonic exercises may be performed; and whereby, in a second mode of use, the apparatus is inverted with said bar member in contact with the floor and supporting said swing arms above the floor to provide a pair of supports upon which a user may rest the forearms while assuming a plank position, said middle portion providing an interface between the user and the floor thereby invoking the user's core muscles to prevent loss of balance.

11. The core-strengthening exercise apparatus of claim 1 wherein said first swing arm and said second swing arm each have a length substantially equal to the length of a human forearm and hand.

12. The core-strengthening exercise apparatus of claim 2 wherein said first swing arm and said second swing arm each have a length substantially equal to the length of a human forearm and hand.

13. The core-strengthening exercise apparatus of claim 3 wherein said first swing arm and said second swing arm each have a length substantially equal to the length of a human forearm and hand.

14. The core-strengthening exercise apparatus of claim 5 wherein said first swing arm and said second swing arm each have a length substantially equal to the length of a human forearm and hand.

15. The core-strengthening exercise apparatus of claim 6 wherein said first swing arm and said second swing arm each have a length substantially equal to the length of a human forearm and hand.

16. The core-strengthening exercise apparatus of claim 7 wherein said first swing arm and said second swing arm each have a length substantially equal to the length of a human forearm and hand.

17. The core-strengthening exercise apparatus of claim 10 wherein said first swing arm and said second swing arm each have a length substantially equal to the length of a human forearm and hand.

* * * * *